US006030236A

United States Patent [19]

Matsuura et al.

[11] Patent Number: 6,030,236

[45] Date of Patent: Feb. 29, 2000

[54] ELECTRICAL CONNECTOR ASSEMBLY SLIDABLY MATING VIA INTERNAL LEVER

[75] Inventors: Toshifumi Matsuura; Toshiaki Okabe; Shinji Kodama, all of Shizuoka, Japan

[73] Assignee: Yazaki Corporation, Tokyo, Japan

[21] Appl. No.: 09/103,560

[22] Filed: Jun. 24, 1998

[30] Foreign Application Priority Data

Jun. 27, 1997 [JP] Japan ..... 9-172227

[51] Int. Cl.[7] ..... H01R 13/62

[52] U.S. Cl. ..... 439/157

[58] Field of Search ..... 439/157, 159, 439/160, 372

[56] References Cited

FOREIGN PATENT DOCUMENTS 6-124747 5/1994 Japan .

6-79080 11/1994 Japan .

*Primary Examiner*—Steven L. Stephan
*Assistant Examiner*—Barry M. L. Standig
*Attorney, Agent, or Firm*—Morgan, Lewis & Bockius LLP

[57] ABSTRACT

In a slidably attaching type connector in which a female type connector housing is attached to and detached from a male type connector housing by using a slide member and a lever, one of the connector housings is slidably received within the slide member. At the time of moving the slide member to one direction, the tip portion of the lever engages with one engaging portion of the other connector housing to draw the one of the connector housings within the other connector housing thereby to attach the male type and female type connector housings to each other. Further, at the time of moving the slide member to a direction opposite to the one direction, another tip portion of the lever engages with the other engaging portion of the other connector housing to detach one of the connector housings from the other connector housing.

8 Claims, 6 Drawing Sheets

ELECTRICAL CONNECTOR ASSEMBLY SLIDABLY MATING VIA INTERNAL LEVER

BACKGROUND OF THE INVENTION

The present invention relates to a slidably attaching type connector in which, when a slide member is slid reciprocally to the attaching and detaching direction of multi-pole female type and male type connector housings, both the connector housings are easily attached and detached to each other due to the leverage of a lever which is rotated by sliding the slide member with a small operation force applied to the slide member.

An example of lever type connectors using lever function is shown in FIGS. 6A and 6B. In FIGS. 6A and 6B, a lever type connector 1 includes a multi-terminal (pole) female connector housing 2. The frame support portion 3 of the female connector housing 2 has a slide groove 4. A slide shaft 6 protruded from the lower side of one end of a frame shaped lever 5 is disposed within and supported by the slide groove so as to be freely slidable within the groove. A pair of male connector housings 7, 7 attachable to and detachable from the female connector housing 2 are rotatably supported by a supporting shaft 8 within the frame shaped lever 5.

When a lever operation portion 9 protruded from the upper side of the other end of the frame shaped lever 5 is operated upward or downward to rotate the lever 5 around the slide shaft 6, the connector housing 2 is attachable to and detachable from the connector housings 7, 7. The technique similar to the lever type connector 1 is disclosed in Japanese Utility Model Unexamined Publication No. Hei.6-79080 or the like.

However, according to the conventional lever type connector 1, in the case of attaching the male connector housings 7 to the female connector housing 2 in a small mounting space or the like where the female connector housing 2 can not be seen, for example, a person is required to grope for positioning the slide shaft 6 serving as a fulcrum of the lever 5 at the slide groove 4 of the flame support portion 3 of the female connector housing 2 and to insert into and engage with the slide groove. Such an operation requires skilled operation and so the attaching operation of the male and female connector housings 2, 7 is troublesome. In particular, at the time of attaching the male connector housings 7 to the female connector housing 2, first, both the male and female connectors 2, 7 are provisionally attached and secondary the lever operation portion 9 is pressed. In this manner, since two steps of the operations are required, it is required to change the holding position of the lever 5 when performing the second operation. Further, since the slide shaft 6 and the lever operation portion 9 are protruded at the both sides of the lever 5 supporting the male connector housings 7, the entire size of the connector is large. Furthermore, there is a possibility that, due to the external load force or the like, the slide shaft 6 of the lever 5 may come out of the slide groove 4 of the frame support portion 3 and the slide shaft 6 and the lever operation portion 9 protruded at the both sides of the lever 5 may be broken.

SUMMARY OF THE INVENTION

The present invention was made in order to solve the aforesaid problem and intends to provide a small-sized slidably attaching type connector with good operability in which one connector housing can be easily attached to and detached from the other connector housing due to the fulcrum function of a lever contained in a slide member by merely sliding the slide member to the attaching/detaching direction with a small operation force.

According to the first aspect of the present invention, in a slidably attaching type connector in which a slide member is provided in one of female type and male type connector housings so as to be slidable reciprocally therein, a base end portion of a lever rotated due to the reciprocal movement of the slide member is rotatably supported by the slide member through a supporting shaft, a halfway portion of the lever is interlocked with a point of action of the one of the female type and male type connector housings, and, at a time of attaching and detaching both the connector housings to each other, a tip portion side of the lever is free to attach to and detach from a pair of engaging portions of the other connector housing, wherein the slide member is provided so as to be slidable reciprocally within the one of the female type and male type connector housings to attaching and detaching direction of the female type and male type connector housings, when the slide member is moved to one direction, the tip portion of the lever engages with one of the pair of engaging portions of the other connector housing to draw the one of the female type and male type connector housings within the other connector housing thereby to attach the both the female type and male type connector housings to each other, and wherein when the slide member is moved to a direction opposite to the one direction, the tip portion of the lever engages with the other of the pair of engaging portions of the other connector housing thereby to detach the one of the female type and male type connector housings from the other connector housing.

According to such a slidably attaching type connector, the attaching and detaching operation between the female type and male type connector housings can be performed easily by merely sliding the slide member to the attaching and detaching direction of the connector housings. In this case, the female type and male type connector housings are smoothly and surely attached and detached to each other due to the leverage of the lever by sliding the slide with a small operation force.

According to the second aspect of the present invention, in the slidably attaching type connector according to the first aspect, the slide member is slidably received within the one of the female type and male type connector housings, and the lever is provided between the slide member and the one of the female type and male type connector housings.

According to such a slidably attaching type connector, since the lever is arranged so as to be contained within the slide member and not to protrude outside thereof, the breakage of the lever due to the external load force or the like applied thereto can be surely prevented. Accordingly, the attaching and detaching operation between the male type and female type connector housings can be performed surely and easily always in a stable state without spoiling the leverage of the lever.

According to the third aspect of the present invention, in the slidably attaching type connector according to the first aspect, a long hole is formed at a halfway portion of the lever, the long hole is slidably engaged with a support pin serving as a point of action of the one of the female type and male type connector housings, whereby the tip portion side of the lever is free to attach to and detach from the pair of engaging portions of the other connector housing.

According to such a slidably attaching type connector, since the length of the lever can be made shorter, the entire size of the connector can be made smaller.

According to the forth aspect of the present invention, in the slidably attaching type connector according to the first aspect, the slide member is formed in a rectangular cylindrical shape, slits are formed at opposed positions of center portions of upper and lower walls of the slide member, respectively, the base end portion of the lever is rotatably supported within one of the slits through a pivot, and the tip portion of the lever is freely inserted in and separated from the other of the slits.

According to such a slidably attaching type connector, due to the leverage of the single lever, the attaching and detaching operation between the multi-pole female type and male type connector housings can be performed surely and easily, and further the number of the parts of the connector can be reduced thereby to reduce the entire cost of the connector.

DETAILED DESCRIPTION OF THE PREFERRED EMBODIMENTS

An embodiment of the present invention will be described with reference to the accompanying drawings.

Figure 1:
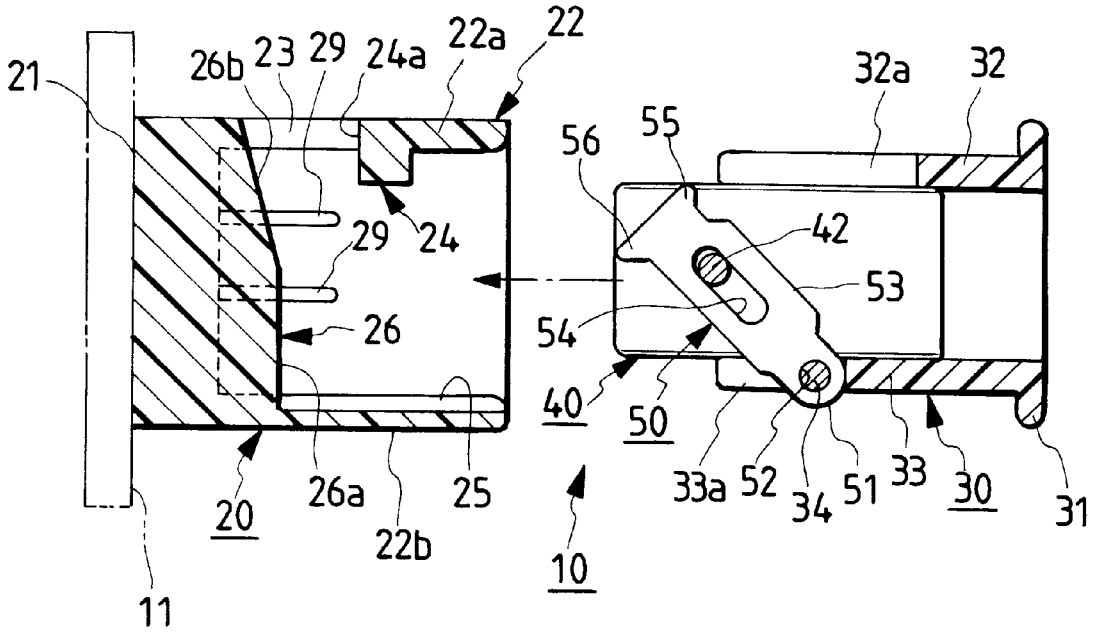
FIG. 1 is a cross-sectional view showing a state where a slidably attaching type connector according to the embodiment of the present invention has not been attached yet.
Figure 2:
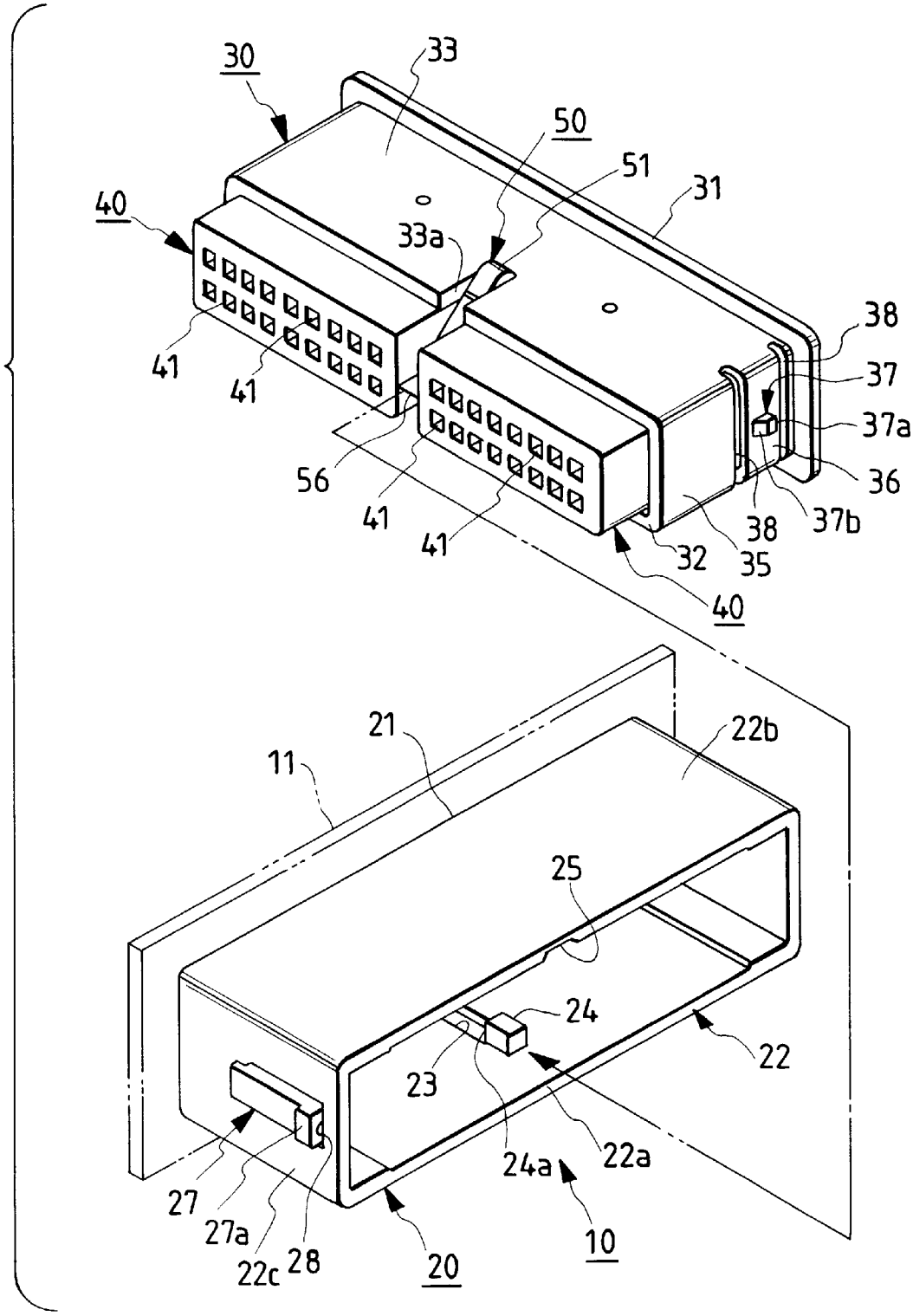
FIG. 2 is a perspective view of a female connector housing and a male connector housing of the slidably attaching type connector according to the embodiment viewed from the bottom side thereof where the slidably attaching type connector has not been attached yet.

FIG. 1 is a cross-sectional view showing a state where a slidably attaching type connector according to the embodiment of the present invention has not been attached yet. FIG. 2 is a perspective view of a female connector housing and a male connector housing of the slidably attaching type connector according to the embodiment viewed from the bottom side thereof where the slidably attaching type connector has not been attached yet.

As shown in FIGS. 1 and 2, a slidably attaching type connector 10 includes a female type connector housing (the other connector housing) 20 made from composite resin in which a plurality of male terminals 29 are protruded from a rear wall 21 within a rectangular shaped hood portion 22 and the rear surface side of the rear wall 21 is fixed to a substrate 11; a rectangular-shaped cylindrical slide cover (slide member) 30 made from composite resin which is free to reciprocally slide within the hood portion 22 of the female type connector housing 20 so as to be attached thereto; a pair of rectangular male type connector housings (one connector housings) 40, 40 made from composite resin which are supported within the slide cover 30 so as to be free to slide reciprocally therein; and a lever 50, made from composite resin and disposed at the center portion of the slide cover 30 between the pair of the male type connector housings 40, 40, which swings or rotates in accordance with the reciprocal slide movement of the slide cover 30 thereby to make the male type connector housings 40, 40 on the movable side attach to and detach from the female type connector housing 20 by the fulcrum function.

An opening portion 23 is formed at the center portion of an upper wall 22*a* of the hood portion 22 of the female type connector housing 20. A block-shaped protrusion portion (one engaging portion) 24 is integrally formed on the inner surface of the upper wall 22*a* of the hood portion 20 at the front end of the opening portion 23 so as to protrude from the upper wall. The rear surface of the protrusion portion 24 and the front end surface of the opening portion 23 form an engaging surface 24*a*. A groove-shaped concave portion (lever guide portion) 25 is formed at the center portion on the inner side of the lower wall 22*b* of the hood portion 22 of the female type connector housing 20 so as to extend from the front end of the lower wall to the rear wall 21. A lib (the other engaging portion) 26 is integrally formed on the rear wall 21 at the center portion of the inner side of the rear wall 21 opposing to the opening portion 23 so as to extend from the rear end of the concave portion 25 and protrude from the rear wall 21. The lib 26 forms a flat surface 26*a* extending from the concave portion 25 side to the center portion and a tapered surface (slanted surface) 26*b* extending from the center portion to the opening portion 23.

As shown in FIGS. 2, and 5A to 5C, a substantially L-shaped flexible release arm (release member) 27 is integrally formed at the center portion of the side wall 22*c* of the hood portion 22 of the female type connector housing 20 so as to protrude from the side wall. The portion of the wall portion 22 peripheral to the base portion of the release arm 27 except for the connection portion to the wall portion 22*c* is notched in a U-shape to form an engaging hole (engaging portion) 28. When a pressing portion 27*a* at the outer front side of the release arm 27 is pressed, a front end corner portion (release portion) 27*b* of the release arm protrudes to the inside of the hood portion (that is, the engaging hole 28 side).

Figure 3:
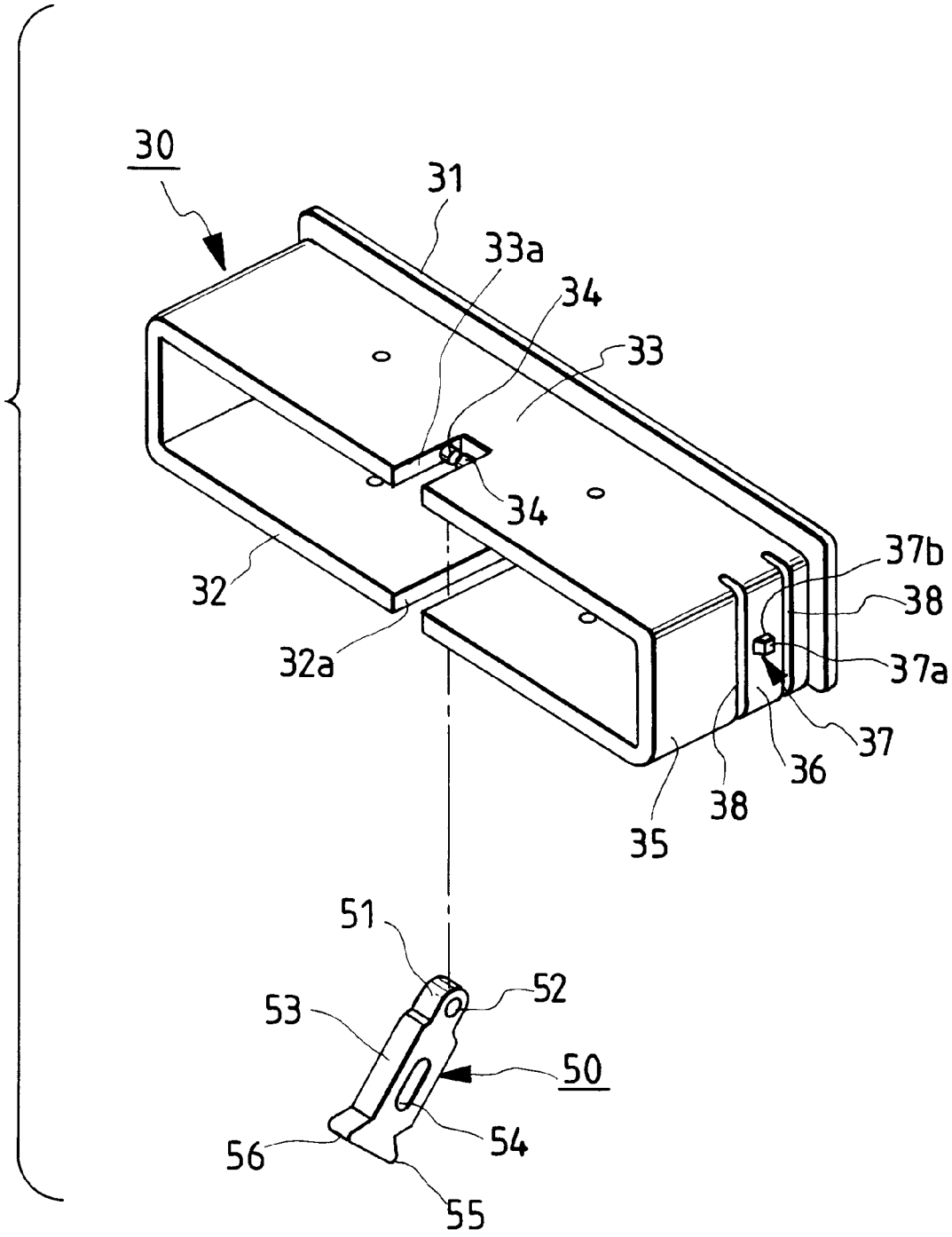
FIG. 3 is a perspective view seen from the bottom side of a slide cover to be received within the male type connector housing and a lever rotatably supported by the slide cover.

As shown in FIGS. 2 and 3, the slide cover 30 is formed in a rectangular cylindrical shape and made from composite resin. The male type connector housings 40, 40 are mounted within the slide cover 30 so as to be freely slidable therein. The slide cover 30 is free to slide within the hood portion 22 of the female type connector housing 20 at the time of detaching the connector housings 20, 40. An annular operation portion 31 is integrally formed at the front end side of the outer periphery of the rectangular cylindrical slide cover 30. A long slit 32*a* and a short slit 33*a* are formed at the center portions of the upper wall 32 and the lower wall 33 of the slide cover 30 so as to oppose to each other, respectively. A pair of pivots 34, 34 for rotatably supporting the base end portion 51 of the lever 50 are integrally formed on the opposed inner surfaces of the lower short slit (one slit) 33*a*. The tip end side of the lever 50 is free to be inserted within and separate from the upper side long slit (the other slit) 32*a*.

Figure 5A:
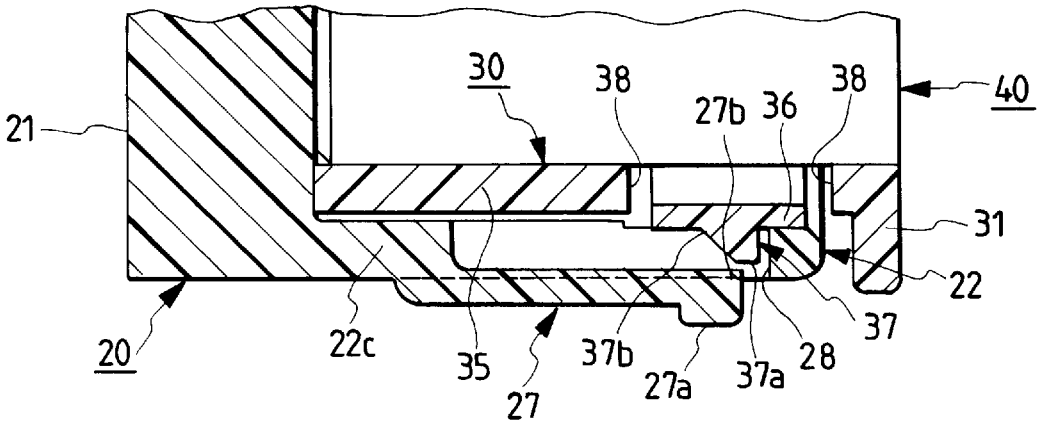
FIG. 5A is a cross sectional view showing the locked state of the female type and male type connector housings of the slidably attaching type connector at the time of attaching them.
Figure 5B:
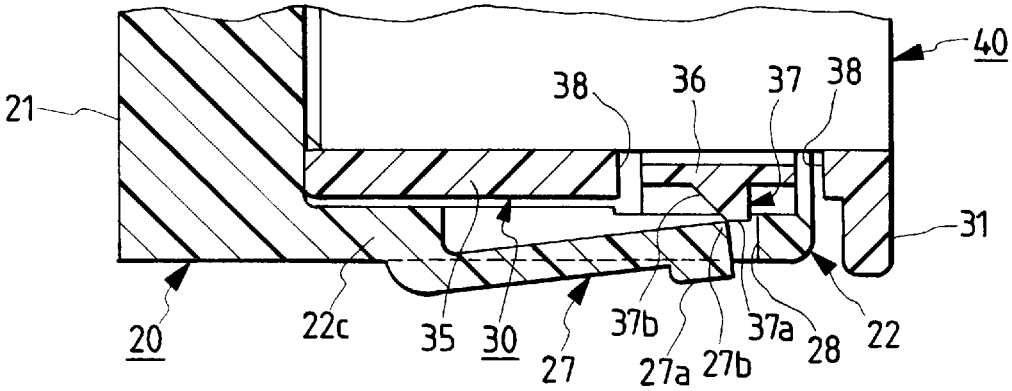
FIG. 5B is a cross sectional view showing the state where the female type and male type connector housings are being unlocked.

A flexible arm (flexible member) 36 is integrally formed at the center front side of the wall 35 of the slide cover 30. The flexible arm 36 with a thin thickness is integrally formed on the front side of the side wall 35 of the slide cover 30 between a pair of notch portions 38, 38 formed in parallel in the side wall 35 in a manner that the flexible arm 36 is flexible toward the inside of the slide cover 30. An engaging portion 37 having a trapezoidal cross-section is integrally formed at the center portion of the flexible arm 36 so as to protrude therefrom. A tapered surface 37*b* is formed on the female type connector housing 20 side of the engaging portion 37 as shown in FIG. 5A. Normally, the front end corner portion 27*b* of the release arm 27 abuts or closes to a flat surface 37*a* of the engaging portion 37, so that the engaging portion 37 of the flexible arm 36 engages with the engaging hole 28 on the release arm 27 side and hence the attached state of the connector housings 20, 40 is freely locked. When the pressing portion 27*a* of the release arm 27 is pressed, the front end corner portion 27*b* of the release arm 27 pushes the flat surface 37*a* of the engaging portion 37 to bend the flexible arm 36 toward the inside of the slide cover 30 thereby to abut the front end corner portion 27*b* of the release arm 27 against the tapered surface 37*b* of the engaging portion 37. As a consequence, the engaging state (locked state) between the engaging portion 37 of the flexible arm 36 and the engaging hole 28 on the release arm 27 side is released, and further the slide cover 30 slightly protrudes outside with respect to the female type connector housing 20 and the male type connector housing 40, so that the slide cover 30 can be easily extracted.

As shown in FIG. 2, each of the male type connector housings 40 is made from composite resin and formed in a substantially rectangular shape, and includes a plurality of terminal receiving chambers 41 between the front and rear surfaces thereof. Each of the terminal receiving chambers 41 contains therein a not-shown female terminal which is electrically connected to the corresponding male terminal 29 of the female type connector housing 20 thereby to electrically connect the connector housings 20, 40 mutually at the time of attaching the connector housings 20, 40. A not-shown wire harness is connected to each of the not-shown female terminals. The lever 50 is provided between the pair of the male type connector housings 40, 40. That is, a cylindrical support pin (action point portion) serving as an action point of the lever 50 is formed at the front side of the center portion of the opposing side surfaces of the male type connector housings 40, 40 through integral-forming, pressing insertion or the like so as to protrude therefrom.

The lever 50 is made from composite resin and formed in a substantially rectangular plate shape, and has a round hole 52 at the center portion of the arc-shaped base end portion 51 thereof. The pair of pivots 34, 34 of the short slit 33*a* at the lower side of the slide cover 30 are fitted into the round hole 52 thereby to rotatably support the base end portion 51 of the lever 50. A long hole (action point receiving portion) 54 is formed at the halfway portion 53 of the lever 50. The long hole 54 is slidably engaged with the support pin 42 of the male type connector housing 40. The tip side of the lever 50 is arranged to form a pair of tip portions 55, 56 protruded in a substantially triangular plate shape to the front and rear sides, respectively. The tip portion (one tip portion) 55 on the forward side is free to attach to and detach from the protrusion portion 24 serving as the one engaging portion of the female type connector housing 20. The tip portion (the other tip portion) 56 on the rear side is free to attach to and detach from the lib 26 serving as the other engaging portion of the female type connector housing 20. Further, the lever 50 is formed in a manner that the distance from the base end portion 51 of the lever to the halfway portion 53 pivotally supported by the support pin 42 of the male type connector housings 40 is longer than the distance from the halfway portion 53 to the tip portions 55, 56.

Figure 4A:
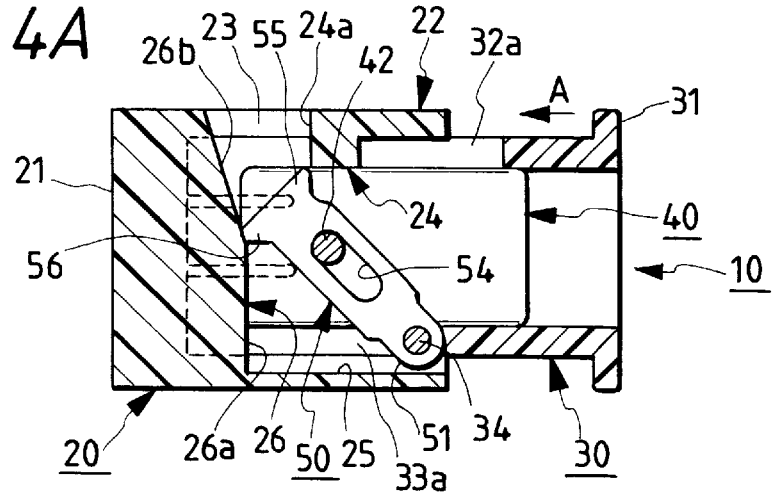
FIG. 4A is a cross sectional view of the female type and male type connector housings at the time of starting the attaching operation therebetween.
Figure 4B:
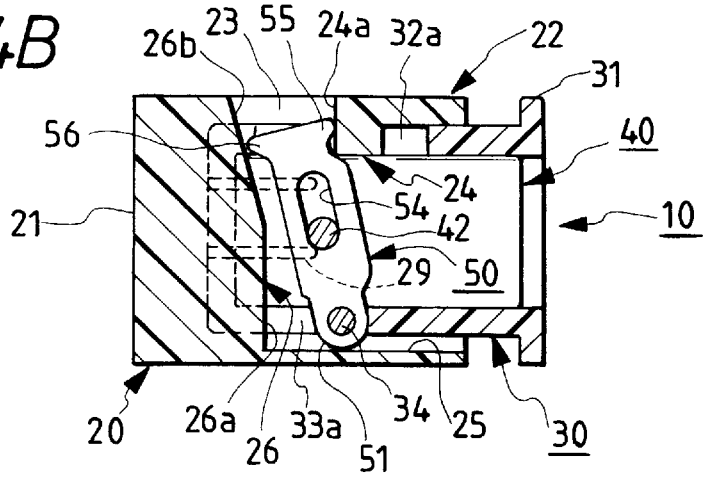
FIG. 4B is a cross sectional view of the female type and male type connector housings during the attaching operation therebetween.

According to the slidably attaching type connector 10 of the embodiment described above, in the state where the female type connector housing 20 and the male type connector housings 40 have not been attached to each other yet (that is, detached state), the lever 50 is placed in a slanted state between the pivot 34 of the slide cover 30 and the support pin 42 of the male type connector housings 40, as shown in FIGS. 1 and 2. In this state, the tip portion side of the slide cover 30 receiving the male type connector housings 40 is inserted within the hood portion 22 of the fixed side female type connector housing 20 thereby to provisionally attach the slide cover 30 to the connector housing 20 as shown in FIG. 4A. Then, if the slide cover 30 is pushed toward such a direction that the female type connector housing 20 and the male type connector housings 40 are attached to each other (that is, a forward direction shown by an arrow A in FIG. 4A), the tip portion 56 of the rear side of the lever 50 at first contacts to the flat surface 26*a* of the lib 26 within the hood portion 22 of the female type connector housing 20 and then contacts to the tapered surface 26*b* thereof. Thus, only the lever 50 rotates due to the initial forward movement of the slide cover 30, so that the tip end portion 55 of the front side of the lever 50 protrudes upward from the opening portion 23 of the female type connector housing 20. As a consequence, the tip end portion 55 of the front side of the lever 50 abuts against the engaging portion 24*a* of the protrusion portion 24 to form the fulcrum as shown in FIG. 4A.

Figure 4C:
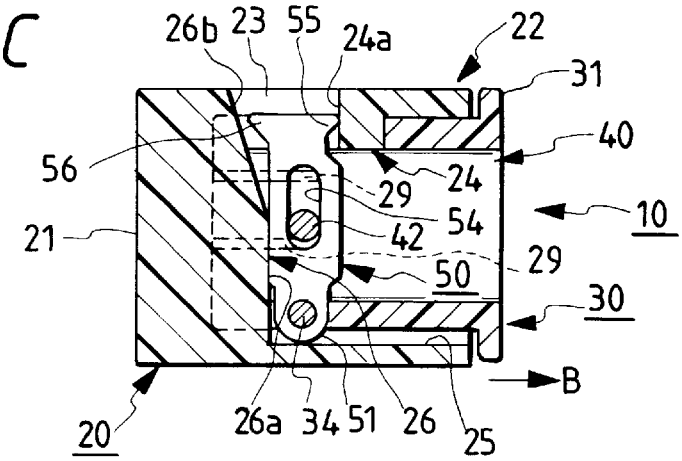
FIG. 4C is a cross sectional view of the female type and male type connector housings at the time of completing the attaching operation therebetween.

In this state, if the slide cover 50 is further pushed toward the forward direction, as shown in FIG. 4C, the male type connector housings 40 are drawn into the hood portion 22 of the female type connector housing 20 by the leverage of the lever 50 (that is, the leverage in which the round hole 52 of the base end portion 51 of the lever 50 serves as a force applying point which is opposite to the point of action through the fulcrum, the support pin 42 of the male type connector housing 40 serves as a point of action, and the tip portion 55 of the front side of the lever 50 serves as a fulcrum), so that the both connector housings 20 and 40 are attached to each other. In this case, as shown in FIG. 5A, since the engaging portion 37 of the slide cover 30 engages with the engaging hole 28 of the female type connector housing 20, the attached state of the both connector housings 20 and 40 are locked. The slide cover 50 moves or slides smoothly without fluctuation until the engaging portion 37 of the slide cover 30 is locked within the engaging hole 28 of the female type connector housing 20 since the base end portion 51 of the lever 50 moves along the recess portion 25 of the female type connector housing 20.

Figure 5C:
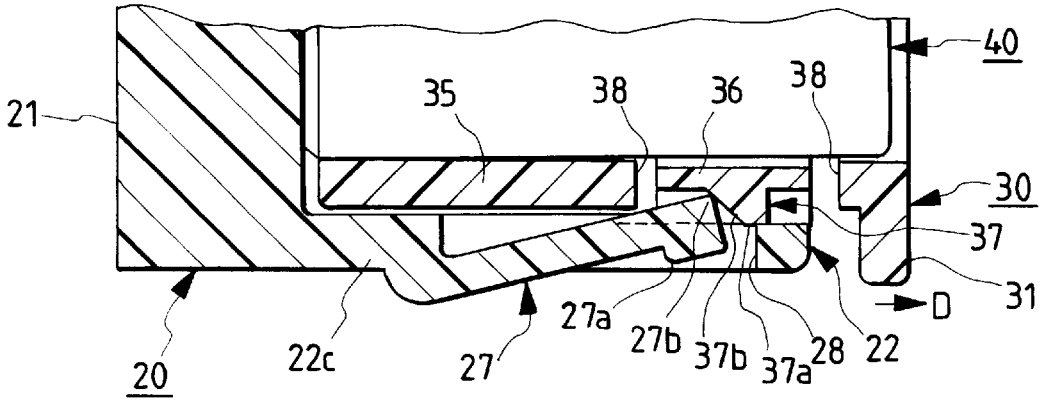
FIG. 5C is a cross sectional view showing the state where the unlocking operation of the female type and male type connector housings has been completed.
Figure 6A:
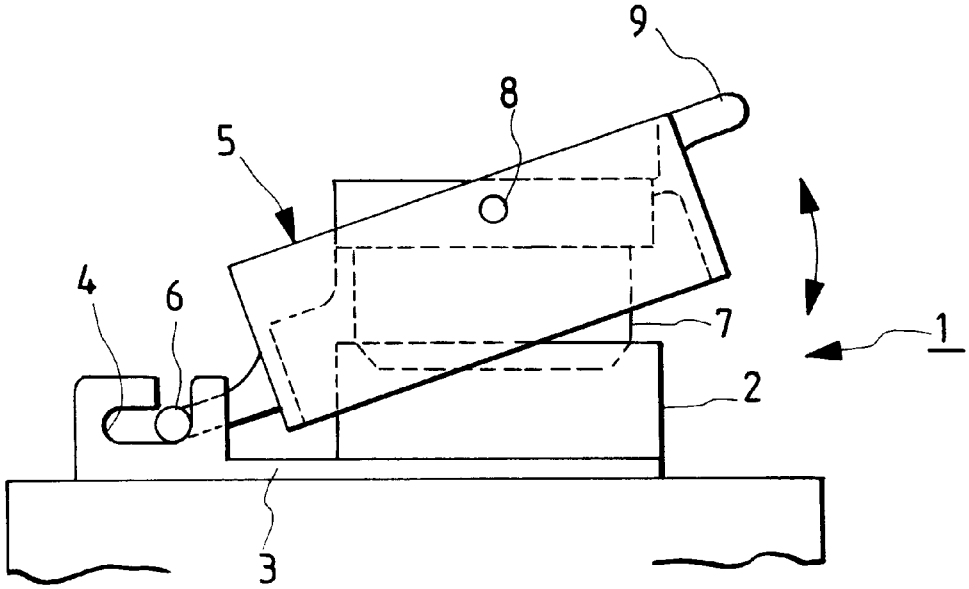
FIG. 6A PRIOR ART
FIG. 6A is a explanatory diagram of an example of the prior art lever type connector.
Figure 6B:
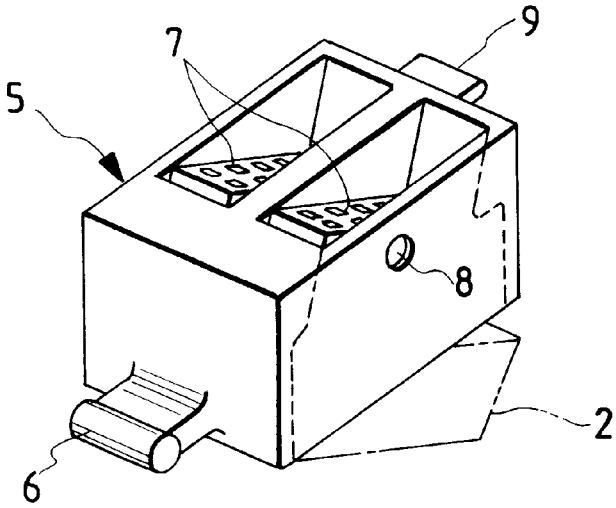
FIG. 6B PRIOR ART
FIG. 6B is a perspective view of the prior art lever type connector seen from the lever side thereof.

At the time of releasing the locking of the attached state, if the pressing portion 27*a* of the release arm 27 of the female type connector housing 20 is pushed, the flat portion 37*a* of the engaging portion 37 of the slide cover 30 is pushed by the front end corner portion 27*b* of the release arm 27, as shown in FIG. 5A. Then, the flexible arm 36 of the slide cover 30 is bent inside thereof, so that the pressing portion 27*a* of the release arm 27 abuts against the tapered surface 37*b* of the engaging portion 37. As a result, as shown in FIG. 5C, the locked state between the engaging portion 37 of the flexible arm 36 and the engaging hole 28 of the release arm 27 side is released. Further, the slide cover 30 slightly is pushed outside (that is, a direction shown by an arrow D in FIG. 5C) with respect to the female type connector housing 20 and the male type connector housing 40, so that the slide cover 30 can be easily extracted. In this state, at the time of detaching the male type connector housing 40 from the female type connector housing 20, if the slide cover 30 is drawn to the reverse direction (that is, a direction shown by an arrow B in FIG. 4C), both the connector housings 20 and 40 are detached to each other by the leverage of the lever 50 (that is, the leverage in which the round hole 52 of the base end portion 51 of the lever 50 serves as a force applying point, the support pin 42 of the male type connector housing 40 serves as a point of action, and the tip portion 55 of the front side of the lever 50 serves as a fulcrum) in accordance with the drawing of the slide cover 30 in a manner that the tip end portion 56 of the rear side of the lever 50 abutting against the tapered surface 26*b* of the lib 26 serves as a fulcrum.

In this manner, according to the embodiment, the slide cover 30 is provided so as to be free to slide reciprocally to such a direction that both the connector housings are attached and detached. Further, when the slide cover 30 moves to the forward direction, the tip portion 55 of the front side of the lever 50 abuts against the engaging portion 24*a* of the protrusion portion 24 of the female type connector housing 20 to draw the male type connector housings 40, 40 into the female type connector housing 20 thereby to mutually attach the connector housings 20, 40. Furthermore, when the slide cover 30 moves to the reverse direction, the tip portion 56 of the rear side of the lever 50 abuts against the tapered surface 26*b* of the lib 26 of the female type connector housing 20 thereby to mutually detach the connector housings 40, 40 from the connector housing 20. Accord to such an arrangement, the attaching and detaching operation between the connector housings 20 and 40, 40 can be performed easily by merely sliding the slide cover 30 to the attaching and detaching direction with a small operation force. In particular, at the time of attaching the connector housings 20 and 40, 40, the attaching operation can be performed by merely pushing the slide cover 30 to the attaching direction. Accordingly, even in the case of attaching the male connector housings to the female connector housing on the fixed side in a small mounting space or the like where the female connector housing can not be seen, for example, both the connector housings 20 and 40, 40 can be attached to each other smoothly in a short time period without requiring skilled operation.

Further, since the lever 50 is arranged so as to be contained within the slide cover 30 and not to protrude outside thereof, the breakage of the lever 50 due to the external load force or the like applied thereto can be surely prevented. Accordingly, the attaching and detaching operation between the connector housings 20 and 40, 40 can be performed surely and easily always in a stable state without spoiling the leverage function (that is, attaching function with a small operation force) of the lever 50. Furthermore, since the length of the lever 50 can be made shorter as much as possible, the entire size of the connector can be made smaller in accordance with the shortened length of the lever 50. Furthermore, due to the leverage of the single lever 50 provided at the center portion of the slide cover 30, the attaching and detaching operation between the multi-pole female type and male type connector housings 20 and 40, 40 can be performed surely and easily, and further the number of the parts of the connector can be reduced thereby to reduce the entire cost of the connector.

Although, in the aforesaid embodiment, only single lever is provided at the center portion of the slide cover, the present invention is not limited thereto, and the present invention may be arranged to provide two or more levers. Further, although, in the aforesaid embodiment, the lever is provided at the male type connector housing side, the present invention is not limited thereto, and the present invention may be arranged to provide the lever at the female type connector housing side.

As described above, according to the first aspect of the present invention, due to the leverage of the lever interlocked with the slide member, the attaching and detaching operation between the male type and female type connector housings can be performed easily by merely sliding the slide member to the attaching and detaching direction with a small operation force.

According to the second aspect of the present invention, since the lever is arranged so as to be contained within the slide member and not to protrude outside thereof, the breakage of the lever due to the external load force or the like applied thereto can be surely prevented. Accordingly, the attaching and detaching operation between the male type and female type connector housings can be performed surely and easily always in a stable state without spoiling the leverage of the lever.

According to the third aspect of the present invention, since the length of the lever can be made shorter as much as possible, the entire size of the connector can be made smaller in accordance with the shortened length of the lever.

According to the forth aspect of the present invention, due to the leverage of the single lever provided at the center portion of the slide member, the attaching and detaching operation between the multi-pole female type and male type connector housings can be performed surely and easily, and further the number of the parts of the connector can be reduced thereby to reduce the entire cost of the connector.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A slidably attaching connector comprising:

a female connector housing;

a male connector housing mating with said female connector housing;

a slide member provided with one of said female and male connector housings so as to be slidable reciprocally therein; and a lever rotated in accordance with a reciprocal movement of said slide member, wherein a base end portion of said lever is rotatably supported by the slide member through a supporting shaft, a halfway portion of the lever is interlocked with a point of action of the one of the female and male connector housings, and, at a time of attaching and detaching both the connector housings to each other, a tip end portion of the lever at an opposite end of said lever from said base end portion is free to attach to and detach from a pair of engaging portions of the other one of the female and male connector housings, wherein the slide member is provided so as to be slidable reciprocally within the one of the female and male connector housings to attaching and detaching direction of the female and male connector housings, wherein when the slide member is moved to one direction, the tip end portion of the lever engages with one of the pair of engaging portions of the other connector housing to draw the one of the female and male connector housings within the other connector housing thereby to attach both of the female and male connector housings to each other, and wherein when the slide member is moved to a direction opposite to the one direction, the tip end portion of the lever engages with the other of the pair of engaging portions of the other connector housing thereby to detach the one of the female and male connector housings from the other connector housing.

2. The slidably attaching connector according to claim 1, wherein the slide member is slidably received within the one of the female and male connector housings, and the lever is provided between the slide member and the one of the female and male connector housings.

3. The slidably attaching connector according to claim 1, wherein a long hole is formed at a halfway portion of the lever, the long hole is slidably engaged with a support pin serving as said point of action of the one of the female and male connector housings, whereby the tip end portion of the lever is free to attach to and detach from the pair of engaging portions of the other connector housing.

4. The slidably attaching connector according to claim 2, wherein a long hole is formed at a halfway portion of the lever, the long hole is slidably engaged with a support pin serving as said point of action of the one of the female and male connector housings, whereby the tip end portion of the lever is free to attach to and detach from the pair of engaging portions of the other connector housing.

5. The slidably attaching connector according to claim 1, wherein the slide member is formed in a rectangular cylindrical shape, slits are formed at opposed positions of center portions of upper and lower walls of the slide member, respectively, the base end portion of the lever is rotatably supported within one of the slits through said supporting shaft, and the tip end portion of the lever is freely inserted in and separated from the other of the slits.

6. The slidably attaching connector according to claim 2, wherein the slide member is formed in a rectangular cylindrical shape, slits are formed at opposed positions of center portions of upper and lower walls of the slide member, respectively, the base end portion of the lever is rotatably supported within one of the slits through said supporting shaft, and the tip end portion of the lever is freely inserted in and separated from the other of the slits.

7. The slidably attaching connector according to claim 3, wherein the slide member is formed in a rectangular cylindrical shape, slits are formed at opposed positions of center portions of upper and lower walls of the slide member, respectively, the base end portion of the lever is rotatably supported within one of the slits through said supporting shaft, and the tip end portion of the lever is freely inserted in and separated from the other of the slits.

8. The slidably attaching connector according to claim 4, wherein the slide member is formed in a rectangular cylindrical shape, slits are formed at opposed positions of center portions of upper and lower walls of the slide member, respectively, the base end portion of the lever is rotatably supported within one of the slits through said supporting shaft, and the tip end portion of the lever is freely inserted in and separated from the other of the slits.

* * * * *